US009640353B2

(12) United States Patent
Sollazzi

(10) Patent No.: US 9,640,353 B2
(45) Date of Patent: May 2, 2017

(54) AXIAL MAGNETIC FIELD COIL FOR VACUUM INTERRUPTER

(71) Applicant: Thomas & Betts International, LLC, Wilmington, DE (US)

(72) Inventor: Bryce Franklin Sollazzi, San Jose, CA (US)

(73) Assignee: Thomas & Betts International LLC, Wilmington, DE (US)

( * ) Notice: Subject to any disclaimer, the term of this patent is extended or adjusted under 35 U.S.C. 154(b) by 0 days.

(21) Appl. No.: 14/853,349

(22) Filed: Sep. 14, 2015

(65) Prior Publication Data

US 2016/0111239 A1 Apr. 21, 2016

Related U.S. Application Data

(60) Provisional application No. 62/066,596, filed on Oct. 21, 2014.

(51) Int. Cl.

| | |
|---|---|
| ***H01H 50/38*** | (2006.01) |
| ***H01H 50/14*** | (2006.01) |
| ***H01H 50/44*** | (2006.01) |
| ***H01H 33/664*** | (2006.01) |

(52) U.S. Cl.

CPC ..... *H01H 50/38* (2013.01); *H01H 33/6642* (2013.01); *H01H 33/6644* (2013.01); *H01H 50/14* (2013.01); *H01H 50/443* (2013.01)

(58) Field of Classification Search

CPC .... H01H 50/38; H01H 50/14; H01H 33/6644; H01H 33/6642; H01H 50/443

See application file for complete search history.

(56) References Cited

U.S. PATENT DOCUMENTS

| | | | |
|---|---|---|---|
| 3,823,287 | A | 7/1974 | Bettge |
| 4,052,576 | A | 10/1977 | Smith |
| 4,052,577 | A | 10/1977 | Votta |
| 4,079,219 | A | 3/1978 | Weston |
| 4,459,446 | A | 7/1984 | Wolf |
| 4,516,004 | A | 5/1985 | Bany et al. |
| 4,620,074 | A | 10/1986 | Paul et al. |
| 4,704,506 | A | 11/1987 | Kurosawa et al. |
| 4,839,481 | A | 6/1989 | Nash et al. |
| 4,871,888 | A | 10/1989 | Bestel |

(Continued)

FOREIGN PATENT DOCUMENTS

| | | | |
|---|---|---|---|
| DE | 4121685 | A1 | 1/1993 |
| DE | 4329518 | A1 | 1/1994 |

(Continued)

*Primary Examiner* — Bernard Rojas

(74) *Attorney, Agent, or Firm* — Taft Stettinius & Hollister LLP

(57) ABSTRACT

A contact assembly for use in a vacuum interrupter includes a contact disc of a first electrically conductive material, a coil, and a contact support. The coil is made from a second electrically conductive material and includes multiple helical sections that are oriented axially with respect to a common central axis. Each of the helical sections includes a proximal end and a distal end such that each of the helical sections is connected at the proximal end to a base made from the second electrically conductive material and is connected at the distal end to the contact disc. The contact support is centered axially within the coil and extends from the base to the contact disc.

20 Claims, 7 Drawing Sheets

(56) References Cited

U.S. PATENT DOCUMENTS

| | | | | |
|---|---|---|---|---|
| 4,935,588 | A | 6/1990 | Hess et al. | |
| 5,055,639 | A | 10/1991 | Schels et al. | |
| 5,387,771 | A | 2/1995 | Luehring | |
| 5,438,174 | A | 8/1995 | Slade | |
| 5,597,992 | A | 1/1997 | Walker | |
| 5,597,993 | A * | 1/1997 | Yorita | H01H 33/6644 218/129 |
| 5,612,523 | A | 3/1997 | Hakamata | |
| 5,777,287 | A | 7/1998 | Mayo | |
| 5,793,008 | A | 8/1998 | Mayo | |
| 5,804,788 | A | 9/1998 | Smith | |
| 6,639,169 | B2 | 10/2003 | Matsui et al. | |
| 6,649,855 | B2 | 11/2003 | Nishijima et al. | |
| 6,740,838 | B2 | 5/2004 | Matsui et al. | |
| 6,867,385 | B2 | 3/2005 | Stoving et al. | |
| 6,965,089 | B2 | 11/2005 | Stoving et al. | |
| 7,721,428 | B2 | 5/2010 | Stoving et al. | |
| 7,781,694 | B2 | 8/2010 | Stoving | |
| 8,087,166 | B2 | 1/2012 | Stoving et al. | |
| 8,164,019 | B2 | 4/2012 | Schlaug et al. | |
| 8,450,630 | B2 | 5/2013 | Stoving | |
| 8,653,396 | B2 | 2/2014 | Li et al. | |
| 8,835,790 | B2 * | 9/2014 | Kantas | H01H 33/6645 218/129 |
| 9,330,868 | B2 * | 5/2016 | Gentsch | H01H 33/6641 |

FOREIGN PATENT DOCUMENTS

| | | | |
|---|---|---|---|
| DE | 9309824 | U1 | 11/1994 |
| GB | 2140972 | A | 12/1984 |

* cited by examiner

AXIAL MAGNETIC FIELD COIL FOR VACUUM INTERRUPTER

CROSS-REFERENCE TO RELATED APPLICATION

This application claims priority under 35 U.S.C. §119, based on U.S. Provisional Patent Application No. 62/066,596 filed Oct. 21, 2014, the disclosure of which is hereby incorporated by reference herein.

BACKGROUND OF THE INVENTION

The present invention relates to high voltage electrical switches, such as high voltage circuit breakers, switchgear, and other electrical equipment. More particularly, the invention relates to an electrical switch whose contacts are located within an insulating environmental enclosure, such as a ceramic bottle.

DETAILED DESCRIPTION OF THE PREFERRED EMBODIMENTS

The following detailed description refers to the accompanying drawings. The same reference numbers in different drawings may identify the same or similar elements.

A contact assembly for use in a vacuum interrupter is provided. In one implementation, two contact assemblies may be provided as a set within a vacuum chamber. Each contact assembly may generate an axial magnetic field to diffuse an arc between the contact assemblies. Each contact assembly may include a contact disc of a first electrically conductive material, a coil, and a contact support. The coil may be made from a second electrically conductive material and includes multiple helical sections that are oriented axially with respect to a common central axis. Each of the helical sections may include a proximal end and a distal end such that each of the helical sections is connected at the proximal end to a base made from the second electrically conductive material and is connected at the distal end to the contact disc. The contact support may be centered axially within the coil and may extend from the base to the contact disc to maintain spacing of the helical sections.

Figure 1A:
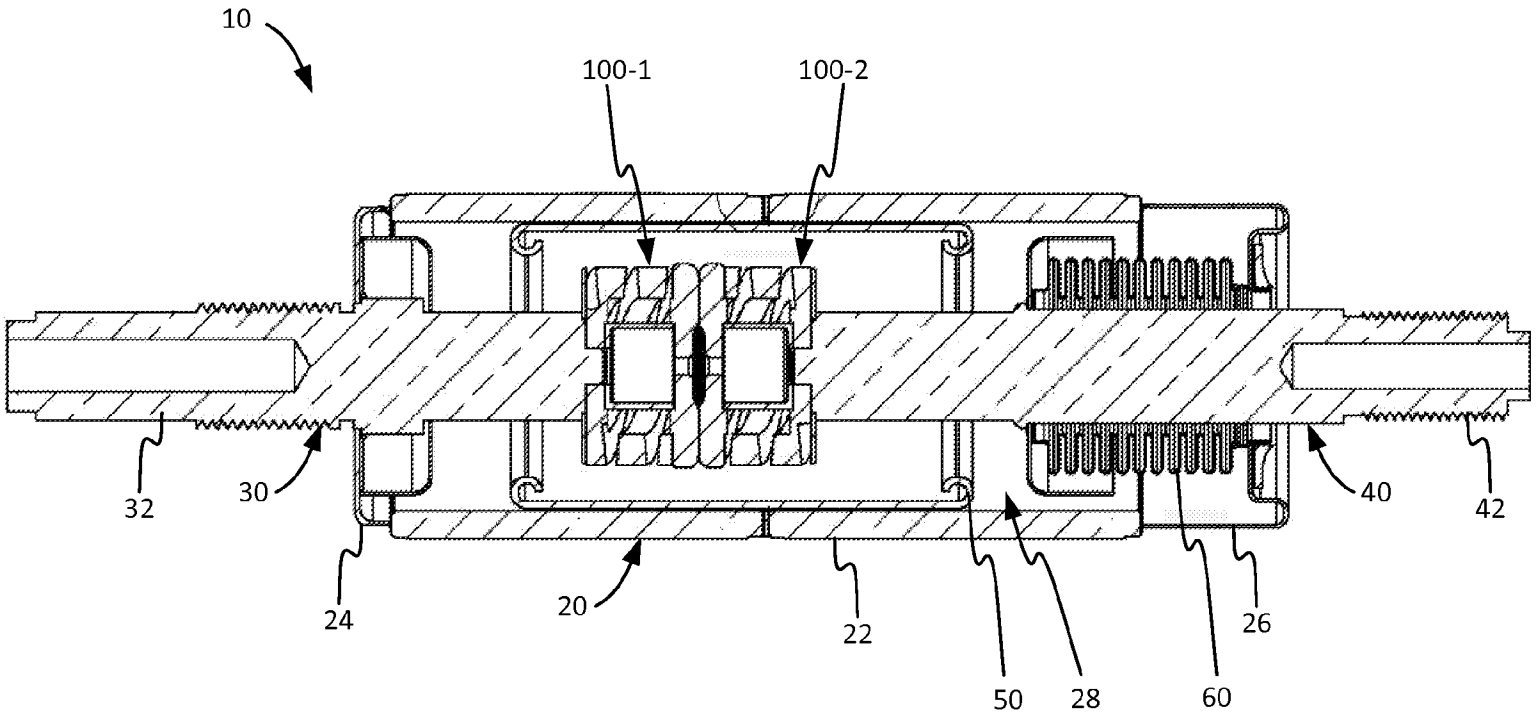
FIGS. 1A and 1B are schematic cross-sectional diagrams illustrating a vacuum interrupter assembly in a closed position and open position, respectively, according to implementations described herein.
Figure 1B:
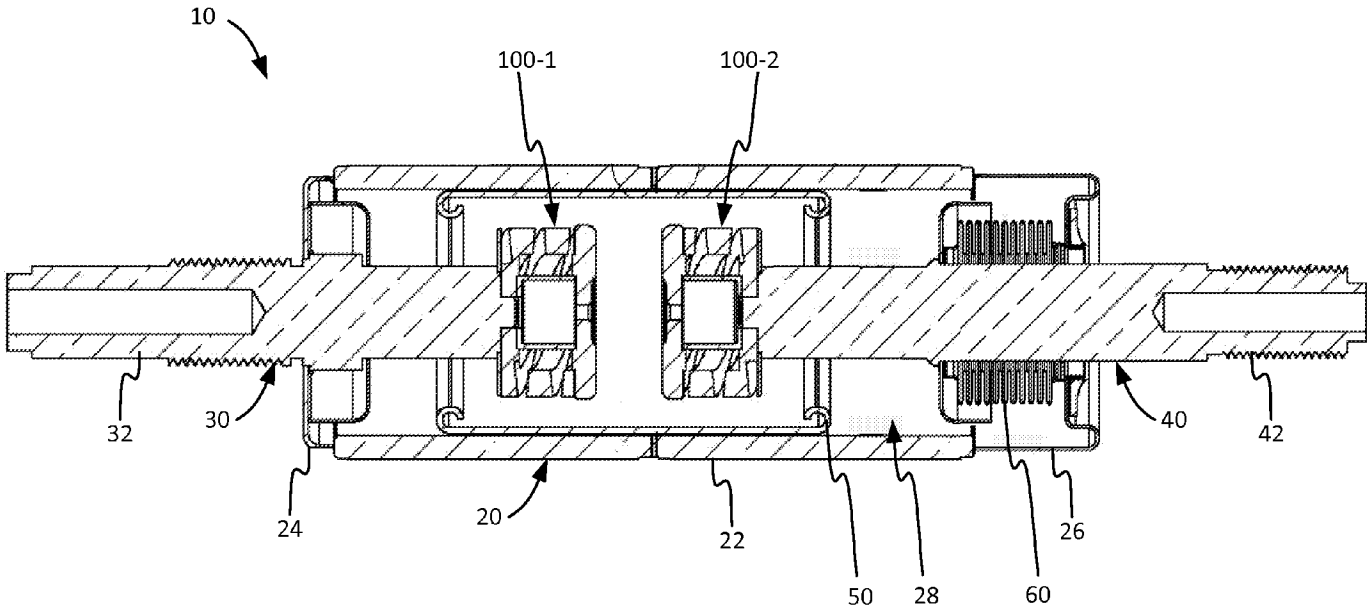

FIG. 1A provides a schematic cross-sectional diagram illustrating a vacuum interrupter assembly 10 in a closed position, and FIG. 1B provides a schematic cross-sectional diagram illustrating vacuum interrupter assembly 10 in an open position. Referring collectively to FIGS. 1A and 1B, vacuum interrupter assembly 10 includes an insulated body 20, a fixed conductor assembly 30, a moveable conductor assembly 40, and an arc shield 50.

Insulated body 20 generally defines an elongated bore, such that fixed conductor assembly 30 and moveable conductor assembly 40 extend axially through the bore of body 20. Insulated body 20 may generally include, for example, a ceramic tube 22 (which may include multiple tube segments joined/sealed together) with flanges 24, 26 on either end of ceramic tube 22. Flanges 24/26 may be joined/sealed to a respective end of ceramic tube 22.

Flange 24 may include an opening to allow a shaft 32 of fixed conductor assembly 30 to extend through. Shaft 32 may be stationary relative to flange 24, and an interface of flange 24 and shaft 32 may be secured with an airtight seal. Flange 26 may include an opening to allow a conductive shaft 42 of moveable conductor assembly 40 to extend through. Shaft 42 may move axially relative to flange 26. Bellows 60 may be provided to allow shaft 42 to move through the opening of flange 26 while maintaining an airtight seal. The airtight seals at the interfaces of ceramic tube 22, flange 24, flange 26, shaft 32, and/or shaft 42 allow for creation of a vacuum chamber 28 within insulated body 20.

As shown in FIGS. 1A and 1B, each of fixed conductor assembly 30 and moveable conductor assembly 40 (also referred to as electrode assemblies) may include a contact assembly 100 (e.g., contact assembly 100-1 and 100-2, referred to herein collectively as "contact assemblies 100" or generically as "contact assembly 100"). Moveable conductor assembly 40 may move between a closed position (FIG. 1A) and an open position (FIG. 1B), using bellows 60 to help maintain a sealed vacuum enclosure within insulated body 20. Each of shaft 32 and shaft 42 may be formed of an electrically conductive material, such as copper, such that an external supply of current can pass through shaft 32/42 to or from a respective contact assembly 100.

In operation, when vacuum interrupter assembly 10 is in the closed position (FIG. 1A), contact assemblies 100-1 and 100-2 come together in a vacuum atmosphere (e.g., within vacuum chamber 28) and current introduced through shaft 32 or 42 flows through contact assemblies 100-1 and 100-2 to the other of shaft 42 or 32. When moving from the closed position to the open position (FIG. 1B), contact assemblies 100-1 and 100-2 are separated and a metal vapor arc, drawn from the switching current may form from vaporized material of contact assemblies 100-1 and 100-2.

Generally, as electric currents approach design limits, the vapor arc can erode contact assemblies 100-1 and 100-2. In conventional contacts, at currents over 10 kiloamps (kA), the vapor arc tends to become constricted, which can result in localized degradation of the contact and a failure to quench the vapor arc. The degree of constriction of the vapor arc may be dependent on (among other features) the geometry of the contact assembly. For example, the geometry of the contact assembly may generate magnetic fields that influence the behavior of the vapor arc.

According to implementations described herein, contact assemblies 100 may generate an axial magnetic field (AMF) that keeps the vapor arc in a non-destructive diffuse mode (e.g., due to the axial magnetic field) and quickly extinguishes the arc to the vacuum atmosphere. As described further herein, contact assemblies 100 may include a multi-arm helical coil structure to generate the axial magnetic field between contact assemblies in high current applications. Vacuum interrupter 10 with contact assemblies 100 may perform well in high-current short circuits (e.g., over 10 kA). Equipment for such high-current conditions may include a circuit breaker, a grounding device, switchgear, or other high voltage equipment.

Figure 2:
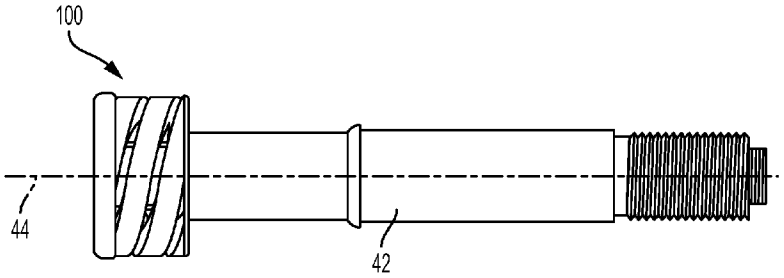
FIG. 2 is a schematic side view of a moveable conductor assembly of the vacuum interrupter assembly of FIG. 1.
Figure 3:
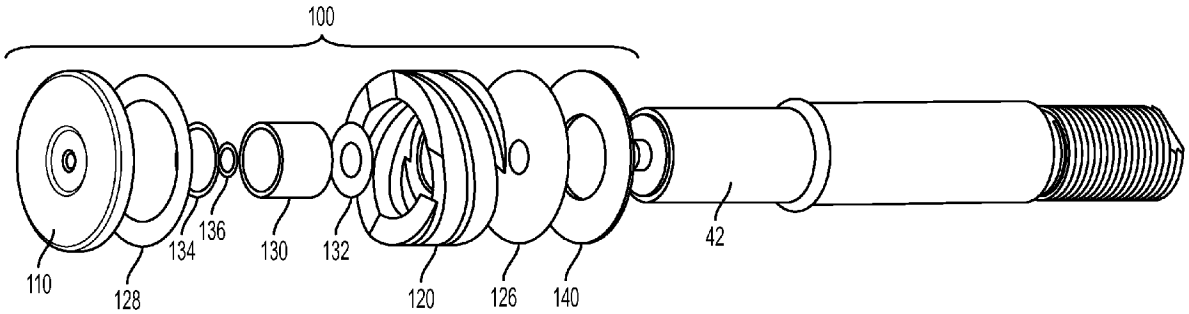
FIG. 3 is a schematic side perspective view of the moveable conductor assembly of FIG. 2.
Figure 4:
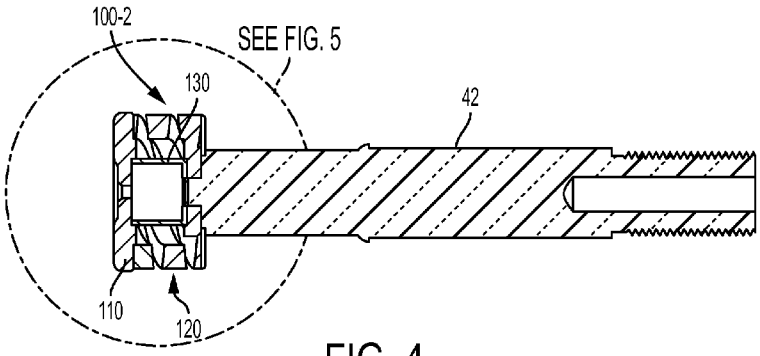
FIG. 4 is a schematic side cross-sectional view of the moveable conductor assembly of FIG. 2.
Figure 5:
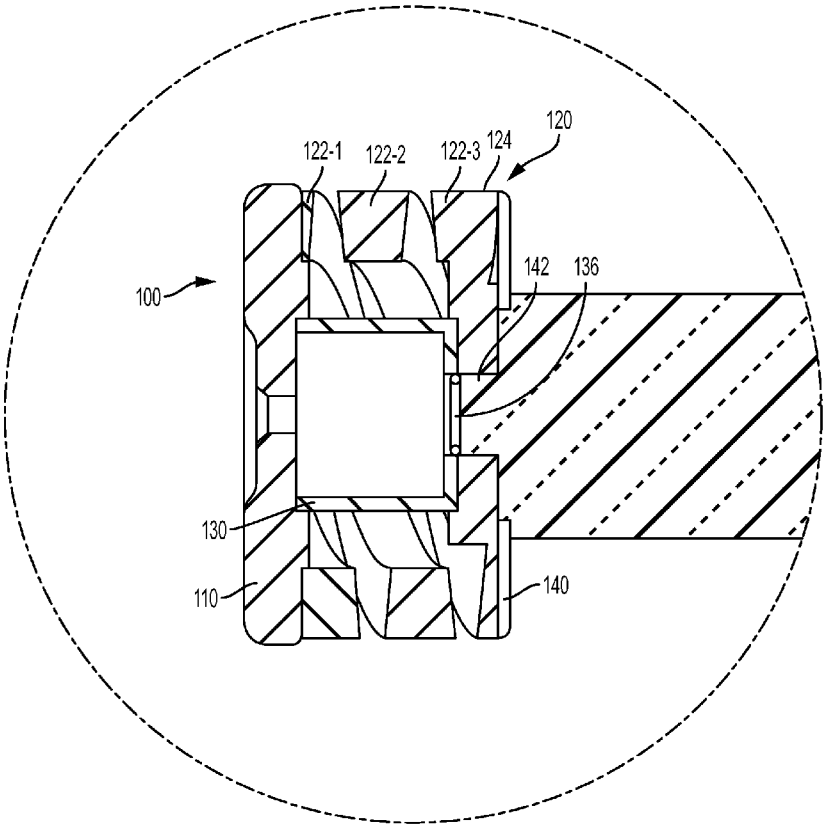
FIG. 5 is an enlarged view of a portion of the side cross-sectional view of FIG. 4.
Figure 6A:
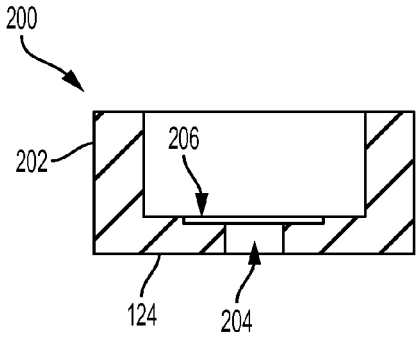
FIGS. 6A and 6B are a cross-sectional side view and a side perspective view of a raw form for an axial magnetic field (AMF) coil.
Figure 6B:
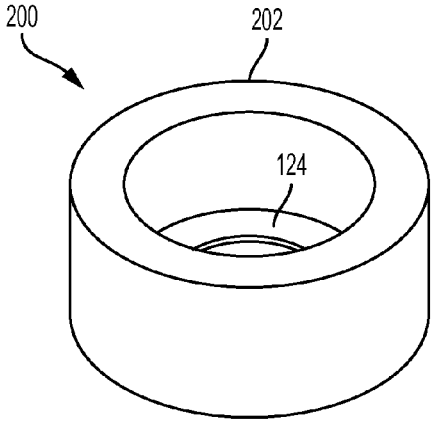
Figure 7A:
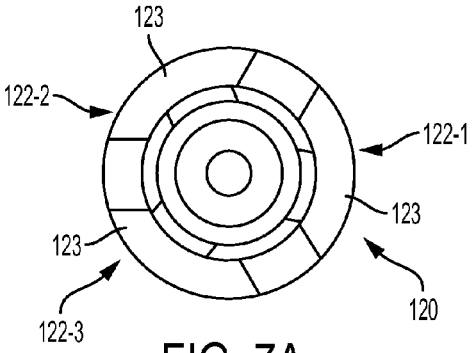
FIG. 7A is a front-end view of an AMF coil.
Figure 7B:
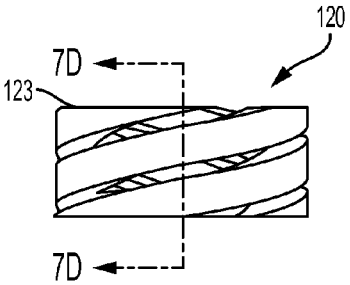
FIG. 7B is a side view of the AMF coil of FIG. 7A.
Figure 7C:
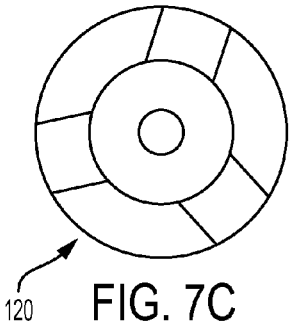
FIG. 7C is a back-end view of the AMF coil of FIG. 7A.
Figure 7D:
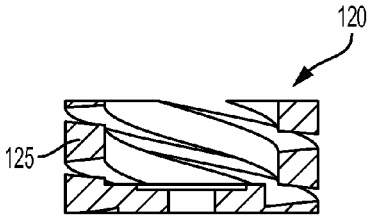
FIG. 7D is a cross-sectional side view of the AMF coil of FIG. 7B.
Figure 8A:
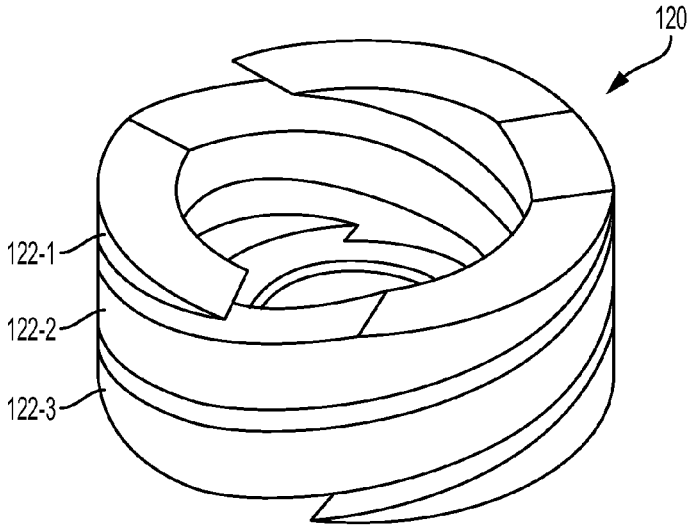
FIGS. 8A and 8B are schematic side perspective views of the AMF coil of FIG. 7A.
Figure 8B:
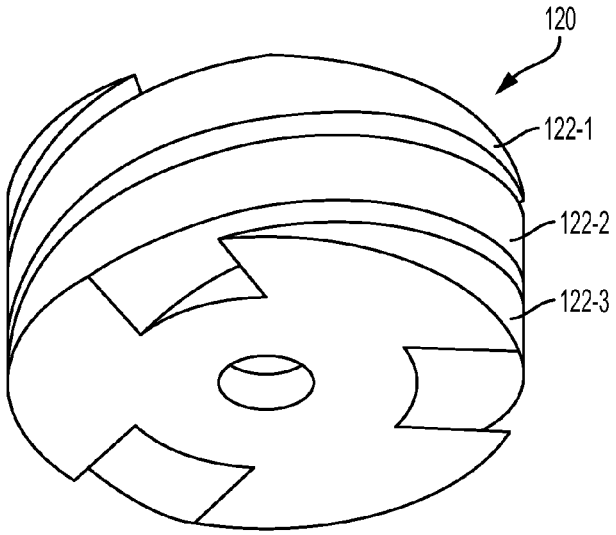

FIG. 2 is a schematic side view of moveable conductor assembly 40, and FIG. 3 is an exploded perspective view of moveable conductor assembly 40. FIG. 4 is a side cross-sectional view of moveable conductor assembly 40 along section A-A of FIG. 2, and FIG. 5 is an enlarged view of a portion B of the side cross-sectional view of FIG. 4. FIG. 6A is a cross-sectional side view of a raw form 200 for AMF coil 120, and FIG. 6B is a perspective view of raw form 200. FIGS. 7A-8B provide different views of AMF coil 120 after machining. Particularly, FIG. 7A is a front-end view of AMF coil 120; FIG. 7B is a side view of AMF coil 120; FIG. 7C is a back-end view of AMF coil 120; and FIG. 7D is a cross-sectional side view of AMF coil 120. FIGS. 8A and 8B are different side perspective views of AMF coil 120. Although not shown in FIGS. 2-8B, fixed conductor assembly 30 may be configured similar to moveable conductor assembly 40.

Referring collectively to FIGS. 2-5, contact assembly 100 may be mounted to an end of shaft 42. Contact assembly 100 may include a contact disc 110, an AMF coil 120, a contact support 130, and a support disc 140. A described further herein contact disc 110, AMF coil 120, contact support 130, and support disc 140 may be joined together to form contact assembly 100 via brazing processes using multiple braze rings/discs. Contact disc 110, AMF coil 120, contact support 130, and support disc 140 may generally be axially aligned with each other and with shaft 42 along a common axis 44.

Contact disc 110 may include a conductive disc that touches another contact (e.g., on contact assembly 100-1) when a vacuum interrupter assembly 10 is in a closed position. Contact disc 110 may include an electrically conductive material that minimizes metal vaporization from arcing when moveable conductor assembly 40 moves from the closed position to the open position. In one implementation, contact disc 110 may be made from a copper (Cu)/chromium (Cr) alloy.

Referring collectively to FIGS. 2-5 and 7A-8D, AMF coil 120 may include multiple (i.e., two or more) helical sections 122 of an electrically conductive material, such as copper. In one implementation, as shown in the attached figures (e.g., FIG. 5), AMF coil 120 may include three helical sections 122-1, 122-2, and 122-3 (referred to herein collectively as "helical sections 122" and generically as "helical section 122") that are connected at a base 124. A proximal end of each helical section 122 may be integrated with base 124 and a distal end of each helical section 122 may be tapered to form a contact area 123 (FIG. 7A). Each helical section 122 may share (e.g., be are oriented axially with respect to) common axis 44. Each contact area 123 may be co-planar with contact areas of each other helical section 122 and may eventually be secured (e.g., brazed) to contact disc 110. In the illustrated configuration, three helical sections 122 are radially offset from each other by 120 degrees and are intertwined with one another to form a coil. According to one implementation, each helical section 122 (e.g., spanning from a proximal end at base 124 to an opposite distal end) corresponds to approximately 0.7 of a revolution of the circumference of the entire AMF coil 120. As a result, AMF coil 120 effectively has 2.1 total revolutions (0.7*3). It should be understood that in other implementations, each helical section may correspond to a higher or lower amount of a revolution and/or more helical sections 122 may be provided.

As shown in FIGS. 2-5, base 124 may be joined (e.g., brazed) to support disc 140 using braze disc 126. Support disc 140 may generally be made from a strong material with a high electrical resistivity, such as stainless steel, that does not affect the axial magnetic field generated from AMF coil 120. Braze disc 126 may be made from copper or another suitable material for brazing the materials of AMF coil 120 to contact support disc 140. Braze disc 128 may be used to join the distal ends of helical sections 122 (i.e., the ends opposite base 124) to contact disc 110. Braze disc 128 may be made from copper or another suitable material for brazing the materials of AMF coil 120 and contact disc 110.

Contact support 130 may have a cylindrical shape to provide axial support for AMF coil 120. Contact support 130 may be positioned within the center of AMF coil 120 and may generally be sized such that the axial length of contact support 130 prevents compression of AMF coil 120. More particularly, contact support 130 is inserted between base 124 and contact disc 110 to maintain the desired configuration (e.g., pitch/gaps) of helical sections 122. In one implementation, contact support 130 is configured to withstand compression forces of up to 200 pounds (e.g., when contact assembly 100-2 moves to the closed position in vacuum interrupter assembly 10). Contact support 130 may generally be made from a hard material that does not affect the axial magnetic field generated from AMF coil 120. In one implementation, contact support 130 may be made from a material with an electrical resistivity greater than 6E-07 ohm-meters, such as some grades of stainless steel.

One end of contact support 130 may be joined (e.g., brazed) to base 124 using braze disc 132. Braze disc 132 may be made from a silver alloy or another suitable material for brazing the materials of AMF coil 120 to contact support 130. Braze disc 134 may be used to join the opposite end of contact support 130 to contact disc 110. Braze disc 134 may be made from a silver alloy or another suitable material for brazing the materials of contact support 130 and contact disc 110. As shown in FIG. 5, braze ring 136 may be located at the interface of base 124 and contact support 130, and on a centering protrusion 142 of shaft 42.

Referring collectively to FIGS. 6A and 6B, a raw form 200 may include a cylinder 202 with an integrated base 124. According to implementations described herein, helical sections 122 may be machined from the solid cylinder 202 wall and base 124 of raw form 200. Raw form 200 may be sized for a particular height (H), wall thickness (T), and base thickness (B), as well as circumference, to provide a required area for helical sections 122 to conduct electrical current to/from shaft 42. According to one implementation, the maximum base thickness B, in a direction of the common axis 44, may be less than the maximum wall thickness T (and the corresponding thickness of each of helical sections 122) in a direction orthogonal to the common central axis.

As shown in FIG. 6A, base 124 may include a centering aperture 204 and a recess 206. Centering aperture 204 may receive centering protrusion 142 when contact assembly 100 (as eventually assembled) is mounted to shaft 42. Recess 206 may receive and center contact support 130 when contact support 130 is eventually assembled within AMF coil 120.

As shown, for example, in FIG. 7C, each of helical sections 122 may be symmetrically distributed about the circumference of AMF coil 120. Thus, for the three-helical-section arrangement shown in FIGS. 7A-8B, the starting point or cut for each of helical sections 122 may be radially offset from each other by 120 degrees.

The length of each helical section (also referred to as helical arm) 122 may be governed, in part, by interrelated geometrical requirements such as the height ("H," FIG. 7B, i.e., equal to the height of raw form 200), a pitch ("P," FIG. 7D) of each cut for helical section 122, a width ("W," FIG. 7D) of each cut, and the cross-sectional area 125 of each helical section 122. Height H may be limited by space constraints within vacuum chamber 28. Pitch P may be limited by a required cross-sectional area and width W between each helical section 122. Width W of each cut should be sufficient to provide an air gap that isolates electrical current though each helical section 122. According to implementations described herein, width W may be measured along (or parallel to) common axis 44. The cross-sectional area for helical sections 122 may be defined by current/voltage requirements and in relation to the cross-sectional area of shaft 42.

In one example, a 0.6-inch height (H), a 0.86 pitch (P), a 0.07-inch width (W), and a 0.0441-square-inch cross-section for each helical section 122 may provide a helical arm 122 with about 0.7 revolutions of the circumference of the entire AMF coil 120 from base 124 of AMF coil 120 to the distal end of each helical section. As a result, the three helical sections 122 of AMF coil 120 effectively provide 2.1 total revolutions (i.e., 0.7*3). It should be understood that other values for H, P, and W may be used in other implementations.

According to other implementations, any configuration of multiple helical sections 122 may be used to provide a combined number of revolutions (or turns) that is greater than two. For example, two helical sections with at least 1.0 revolutions or four helical sections with at least 0.5 revolutions may be used. Generally, the multiple helical sections may be symmetrically distributed (e.g., with the same radial offset and pitch for each helical sections) about the circumference of AMF coil 120.

According to an implementation described herein, a contact assembly for use in a vacuum interrupter may include a contact disc of a first electrically conductive material (i.e., a Cu/Cr alloy), a coil, and a contact support. The coil is made from a second electrically conductive material (i.e., Cu) and includes multiple helical sections that share a common axis. Each of the helical sections includes a proximal end and a distal end such that each of the helical sections is connected at the proximal end to a base made from the second electrically conductive material and is connected at the distal end to the contact disc. The contact support is centered axially within the coil and extends from the base to the contact disc.

According to another implementation, identical contact assemblies (e.g., contact assemblies 100-1 and 100-2) may be mounted on a stationary conductive shaft (e.g., shaft 32) and a moveable conductive shaft (e.g., shaft 42) within a vacuum chamber (e.g., vacuum chamber 28).

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments. For example, implementations described herein may also be used in conjunction with other devices, such as medium or low voltage equipment.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above-mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A contact assembly for use in a vacuum interrupter, the contact assembly comprising:

a contact disc of a first electrically conductive material;

a coil, of a second electrically conductive material, including multiple helical sections that are oriented axially with respect to a common central axis, wherein each of the helical sections includes a proximal end and a distal end, wherein each of the helical sections is connected at the proximal end to a base made from the second electrically conductive material, and wherein each of the helical sections is connected at the distal end to the contact disc;

a contact support centered axially within the coil and extending from the base to the contact disc; and a support disc joined to the base, the base being interposed between the support disc and the contact support, the support disc structured to provide support to the base and constructed from a material having a relatively high electrical resistivity.

2. The contact assembly of claim 1, wherein the base and each of the helical sections are machined from a common part, and wherein the material of the support disc is stainless steel.

3. The contact assembly of claim 1, wherein the multiple helical sections consist of three helical arms radially offset from each other by 120 degrees, and wherein the support disc is brazed to the base of the coil.

4. The contact assembly of claim 3, wherein each of the helical sections spans at least 0.7 revolutions of a circumference of the coil.

5. The contact assembly of claim 1, further comprising:

a conductive shaft having a first protrusion, the first protrusion extending through a first aperture of the support disc and a second aperture of the contact support, the support disc interposed between the base and at least a portion of the conductive shaft, and wherein the base is interposed along the common central axis.

6. The contact assembly of claim 1, wherein the contact support includes a stainless steel cylinder.

7. The contact assembly of claim 1, wherein the combined number of revolutions formed by the multiple helical sections, with respect to a circumference of the coil, is greater than two.

8. The contact assembly of claim 1, wherein the base of the coil includes a first aperture and the support disc includes a second aperture, the first and second apertures positioned along the common axis, that is sized to receive a protrusion of an electrically conductive shaft.

9. The contact assembly of claim 8, wherein the base includes a recess sized to receive and axially center the contact support.

10. The contact assembly of claim 1, wherein the each of the multiple helical sections are separated from another of the multiple helical sections by at least a 0.07-inch gap measured along the common central axis.

11. The contact assembly of claim 1, wherein each distal end of the multiple helical sections is brazed to the contact disc.

12. The contact assembly of claim 1, wherein the contact assembly is configured to withstand an applied force of at least 200 pounds in a direction of the common axis.

13. The contact assembly of claim 1, wherein the maximum thickness of the base, in a direction of the common central axis, is less than the maximum thickness of each of the multiple helical sections, in a direction orthogonal to the common central axis.

14. The contact assembly of claim 1, wherein the contact disc includes a recess sized to receive and axially center the contact support.

15. A vacuum interrupter, comprising:

a vacuum chamber;

a first contact assembly within the vacuum chamber, wherein the first contact assembly is affixed to a stationary conductive shaft; and a second contact assembly within the vacuum chamber, wherein the second contact assembly is affixed to a moveable conductive shaft, wherein the first contact assembly and the second contact assembly each include:

a contact disc of a first electrically conductive material, a coil, of a second electrically conductive material, including multiple helical sections that are oriented axially with respect to a common central axis, wherein each of the helical sections includes a proximal end and a distal end, wherein each of the helical sections is connected at the proximal end to a base made from the second electrically conductive material, and wherein each of the helical sections is connected at the distal end to the contact disc, and a contact support centered axially within the coil and extending from the base to the contact disc, a support disc joined to the base, the base being interposed between the support disc and the contact support, the support disc being structured to support the base and constructed from a material having a relatively high electrical resistivity.

16. The vacuum interrupter of claim 15, wherein each of the coils generates an axial magnetic field (AMF) in response to an electric current introduced through the stationary conductive shaft or the moveable conductive shaft and wherein the support disc is interposed between base and at least a portion of the adjacent one of the stationary conductive shaft and the moveable conductive shaft.

17. The vacuum interrupter of claim 15, wherein the support disc of the first contact assembly is interposed between the base and at least a portion of the stationary conductive shaft, and wherein the support disc of the second contact assembly is interposed between the base and at least a portion of the moveable conductive shaft.

18. The vacuum interrupter of claim 15, wherein the stationary conductive shaft includes a first protrusion centered along the common axis to receive the first contact assembly, and wherein the moveable conductive shaft includes a second protrusion centered along the common axis to receive the second contact assembly, and further wherein the base and the support disc of the first and second contact assemblies each include an aperture sized to receive insertion of the first and second protrusion of the adjacent one of the stationary conductive shaft and the moveable conductive shaft.

19. A contact assembly for use in a vacuum interrupter, the contact assembly comprising:

a contact disc of a first electrically conductive material;

a coil, of a second electrically conductive material, the coil including three helical sections that share a common central axis, wherein an end of each of the three helical sections is brazed, along a contact area, to the contact disc;

a contact support centered axially within the coil and contacting the contact disc, wherein the contact support prevents compression of the coil; and a support disc joined to a base of the coil, the base being interposed between the support disc and the contact support, the support disc structured to provide support to the base and constructed from a material having a relatively high electrical resistivity.

20. The contact assembly of claim 19, wherein the coil includes an integrated base from which each of the helical sections extend, and wherein the support disc is brazed to the base of the coil.

* * * * *